US007077243B2

(12) United States Patent
Huber et al.

(10) Patent No.: US 7,077,243 B2
(45) Date of Patent: Jul. 18, 2006

(54) ELEVATOR INSTALLATION WITH A BUFFER FOR CREATING A ZONE OF PROTECTION IN AN ELEVATOR INSTALLATION AND A METHOD OF CREATING A ZONE OF PROTECTION

(75) Inventors: Marcel Huber, Ebikon (CH); Johannes Kocher, Udligenswil (CH)

(73) Assignee: Inventio AG, Hergiswil (CH)

( * ) Notice: Subject to any disclaimer, the term of this patent is extended or adjusted under 35 U.S.C. 154(b) by 154 days.

(21) Appl. No.: 10/844,936

(22) Filed: May 14, 2004

(65) Prior Publication Data

US 2004/0251086 A1 Dec. 16, 2004

(30) Foreign Application Priority Data

May 21, 2003 (EP) ..... 03405352

(51) Int. Cl.
*B66B 5/28* (2006.01)
*B66B 5/16* (2006.01)

(52) U.S. Cl. ..... 187/357; 187/343; 187/344; 187/351

(58) Field of Classification Search ..... 187/343, 187/357, 344, 351
See application file for complete search history.

(56) References Cited

U.S. PATENT DOCUMENTS 787,258 A * 4/1905 Austin ..... 187/343
2,503,954 A * 4/1950 Lindahl ..... 187/357
5,727,657 A * 3/1998 Foelix ..... 187/356
5,806,633 A * 9/1998 Macuga ..... 187/357
6,095,288 A * 8/2000 Rivera et al. ..... 187/343
6,138,798 A * 10/2000 Macuga ..... 187/294
6,736,242 B1 * 5/2004 Nygren ..... 187/357

FOREIGN PATENT DOCUMENTS

| | | | |
|---|---|---|---|
| EP | 0725033 | | 8/1996 |
| EP | 1052212 | | 11/2000 |
| EP | 1052212 | A1 * | 11/2000 |
| JP | 05201647 | | 8/1993 |
| JP | 05201647 | A * | 8/1993 |
| JP | 09227046 | | 9/1997 |
| JP | 09227046 | A * | 9/1997 |
| WO | WO 00/64798 | | 11/2000 |
| WO | WO 02/051737 | | 7/2002 |

* cited by examiner

*Primary Examiner*—Kathy Matecki
*Assistant Examiner*—Eric E. Pico
(74) *Attorney, Agent, or Firm*—Butzel Long

(57) ABSTRACT

A buffer creates at least one zone of protection in an elevator installation including an elevator car and a counterweight movable along respective paths in an elevator shaft. The buffer has a movable portion movable into the path of the elevator car and/or into the path of the counterweight in such a manner that the elevator car or the counterweight can be brought into mechanical contact with the movable portion and each of the elevator car and the counterweight is supported at a predetermined height above a floor of the elevator shaft so that a zone of protection is available below or above the elevator car.

19 Claims, 5 Drawing Sheets

ELEVATOR INSTALLATION WITH A BUFFER FOR CREATING A ZONE OF PROTECTION IN AN ELEVATOR INSTALLATION AND A METHOD OF CREATING A ZONE OF PROTECTION

BACKGROUND OF THE INVENTION

The present invention is an elevator installation with a buffer for creating a zone of protection. A method of creating a zone of protection is a further subject of the invention.

Elevator installations are usually provided with one or more buffers which are arranged at the shaft floor of an elevator shaft in order to stop the elevator car when overrunning the lowermost stopping position in the elevator shaft in the downward direction and/or when overrunning the uppermost stopping position in the elevator shaft in the upward direction after transit of a predetermined travel path. This buffer is usually seated below the elevator car and/or the counterweight.

In order to prevent overrunning of an uppermost stopping position in the elevator shaft in the upward direction at the latest after transiting a predetermined travel path, buffers can also be arranged at the shaft head above the elevator car. Due to the fact that such buffers have to be arranged at the shaft floor or shaft head directly below or above the elevator car, a specific space requirement results. The shaft head or the shaft floor can therefore only be conditionally utilized for other purposes. In the case of elevator installations without a shaft pit, such a standard arrangement of a buffer is not possible, since little space is present underneath the elevator car.

An elevator installation with an elevator shaft, a vertically movable elevator car with a counterweight and with buffers is described in PCT Patent Application WO 00/64798-A1, wherein the buffer is disposed not below the elevator car, but near the elevator car at the shaft floor. The elevator car is provided with brackets which impinge on the buffer if an overrun situation arises, i.e. if the elevator car goes beyond the lowermost stopping position at the lowermost floor in the downward direction. The elevator car is thereby braked and stopped in a short distance above the shaft floor. An overrun protection against overrunning the uppermost stopping position of the elevator car in the upward direction is not proposed in this PCT patent application. The elevator installation has a shaft without a pit. A possibility of creating temporary zones of protection for carrying out maintenance and repair operations in the elevator shaft at the shaft floor and/or at the shaft head is not disclosed.

There is frequently too little space due to constructional or other reasons for a conventional elevator installation with a shaft pit and a shaft head. It may be observed that elevator shafts without an elevator pit and without an elevator head are used particularly in the case of subsequent installation or addition of an elevator installation in an already existing building. In the case of elevator shafts of that kind, but also in the case of conventional elevator shafts, there are situations in which it is necessary to create a zone of protection at the upper or lower shaft end. This is so, for example, when the elevator installation has to be maintained or checked and when for this purpose an engineer has to go into the shaft.

It is important that a system for creating such a temporary zone of protection is safe. There are different proposed solutions for that purpose. The costs and the space requirement for such a system are a further criterion. In addition, a simple checking and maintenance of the system for creating a temporary zone of protection is important. The cost in assembly and the initial aligning of all parts of such a system are also a further criterion which has to be taken into consideration.

An elevator installation with an elevator shaft and a vertically movable elevator car with counterweight is described in European Patent Application EP 0 725 033-A1. Provided at the shaft base is a touch-down device which comprises a pivotable buffer able to be pivoted into the travel path of the elevator car. A zone of protection at the shaft base can thereby be created if needed. As a special form of embodiment there is proposed a combination of a shaft buffer, which is set up outside a path of an elevator car, with a rigid pivot lever pivotable into the path of the elevator car. The elevator car when hitting the pivot lever can thus be braked by the shaft buffer and supported above the shaft floor at a height which lies above the lowermost stopping position of the elevator car.

It is a disadvantage of this form of embodiment that it is indeed suitable for creating a zone of protection at the shaft floor, but does not offer any possibility of stopping overrunning of the lowermost stopping position of the elevator car in the elevator shaft in the downward direction after transiting a predetermined travel path. A possibility of creating a zone of protection at the shaft head is also not provided.

An elevator installation with an elevator shaft, a vertically movable elevator car with a counterweight and a movable support device is described in PCT Patent Application WO 02/051737-A1. The support device is arranged eccentrically at the shaft base between the elevator car and the counterweight and can be moved into the path of the elevator car when necessary. The support device comprises a plate which is pivotably articulated to the shaft floor. If required, this plate is simply pivoted in the direction of the elevator car. Disposed at the elevator car is a buffer which impinges on the plate and stops the elevator car at a predetermined spacing from the shaft floor. A zone of protection at the shaft floor can thereby be created in the case of need. In order to be able to create a zone of protection in the region of the shaft head the elevator car comprises, according to the PCT patent application, a device which is fastened to the roof of the elevator car. This device can be pivoted up and moves against the shaft roof. A zone of protection is thus created at the upper end of the shaft. This PCT patent application is considered to the closest state of the art.

It is a disadvantage of this form of embodiment that for creating a zone of protection at the shaft head there is needed a device which is seated on the elevator car. The mass to be accelerated and moved is thereby increased.

SUMMARY OF THE INVENTION

The present invention has the object of providing a solution which makes it possible to create a zone of protection at the lower or at the upper end of an elevator shaft in the case of need.

The elevator installation according to the invention comprises a buffer, which comprises movable means movable into the path of the elevator car and movable means movable into the path of the counterweight.

The movable means movable into the path of the elevator car and the movable means movable into the path of the counterweight can be realized as, for example, a single movable part which is so movable between different positions that it can be brought not only into the path of the elevator car, but also into the path of the counterweight. It is also possible to realize the movable means movable into the path of the elevator car and the movable means movable into the path of the counterweight in each instance by different parts movable independently of one another. For example, a first movable part could be so arranged at the buffer that it is movable into the path of the elevator car and a second movable part could be so arranged at the buffer that it is movable into the path of the counterweight.

Consequently, the movable means can be brought into a use setting in which they are arranged in such a manner that the elevator car and/or the counterweight can be brought into a mechanical contact with the movable means. It is thereby made possible to be able to selectably support the elevator car or the counterweight in a first or a second predetermined spacing above a floor by a single buffer. The predetermined first spacing and the predetermined second spacing can be different depending on the respective arrangement and form of the buffer or the movable means. The elevator car and the counterweight can accordingly be supported at different heights.

In a normal setting of the movable means, the movable means are not disposed in the paths of the elevator car in the counterweight. Consequently, the space available for the elevator car is not restricted when the movable means are brought into the use setting. Due to the fact that selectably the elevator car or the counterweight can each be supported at a predetermined spacing above the floor, the path which the elevator car can travel over is shortened at both ends. Protective spaces are thus created at both ends of the path of the elevator car.

A further form of embodiment of the buffer according to the present invention comprises a damping element which is arranged in such a manner that it projects into the path of the elevator car when the movable means are brought into the normal setting, wherein the damping element is constructed in such a manner that the elevator car can be brought into a mechanical contact with the damping element and can be supported at a third spacing above the floor which is smaller than the first predetermined spacing. This form of embodiment is also usable as an overrun protection, which brakes and stops the elevator car on overrunning a lowermost stopping position in the downward direction.

One form of embodiment of the buffer according to the present invention can comprise a damping element which is arranged in such a manner that it projects into the path of the counterweight when the movable means are brought into the normal setting, wherein the damping element is constructed in such a manner that the counterweight can be brought into a mechanical contact with the damping element and can be supported at a fourth spacing above the floor which is smaller than the second predetermined spacing. This buffer can be used as an overrun protection which through mechanical contact with the counterweight brakes and stops the counterweight in the downward direction and thus brakes and stops the elevator car on overrunning an uppermost stopping position in the upward direction.

The buffer can be developed in such a manner that a damping element projects into the paths of the elevator car and the counterweight when the movable means are brought into the normal setting. Thus, solely through selection of the arrangement of a single buffer the elevator car can be prevented from overrunning a lowermost stopping position in the downward direction and an uppermost stopping position in the upward direction.

This form of embodiment is accompanied by the advantage that with a single buffer—depending on the respective selection of the setting of the movable means—the elevator car and/or the counterweight can each be supported at at least two different spacings above a floor. Such a buffer can, if suitably dimensioned, ensure, in an elevator installation without a pit, an overrun protection against overrunning a lowermost stopping position of the elevator car in the downward direction and against overrunning an uppermost stopping position of the elevator car in the upward direction and additionally—in case of an appropriate setting of a movable means—enable creation of temporary protection spaces below and above the elevator car.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1A:
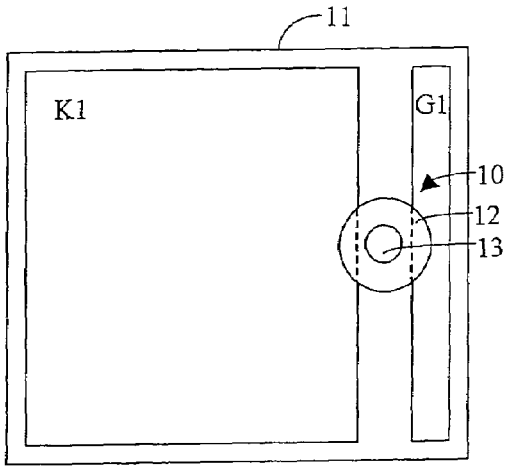
FIG. 1A is a schematic plan view of a first embodiment of a buffer according to the present invention, in a normal state.

FIGS. 1A to 1F show a first form of embodiment of an elevator car with a buffer 10, according to the present invention, in different schematic views and in different states. The illustrated buffer 10 is a buffer for supporting an elevator car 15 above a floor 18 of an elevator shaft 11. The elevator car 15 is so connected with a counterweight 23 by way of a support means 23.1, for example one or more cables and/or one or more belts, that the elevator car 15 and the counterweight 23 are movable upwardly and downwardly along paths $V_K$ and $V_G$, respectively, in the elevator shaft 11. The counterweight, a support means, a drive pulley for the support means, a drive for the drive pulley, guide rails for the elevator car 15 and the counterweight and the other usual elements of a elevator installation are not shown in FIGS. 1A to 1D.

The buffer 10 has a longitudinal extent substantially parallel to the paths $V_K$ and $V_G$ of the elevator car 15 and counterweight 23. It comprises a lower base element 12 and a more slender upper part 13. The buffer additionally comprises movable means 14 and 14.1 which can be moved out of the upper part 13, as indicated in FIGS. 1C, 1D and 1E. In addition, there is provided a drive device (not illustrated) which makes it possible to move the means 14 and 14.1 in each instance between different settings. A control device (not illustrated), which acts on the drive device, makes it possible to check and monitor the positioning of the means 14 and 14.1.

The paths $V_K$ and $V_G$ are indicated in FIGS. 1B and 1D to 1F by dashed lines. The buffer 10 is disposed at least partly between the path $V_K$ of the elevator car 15 and the path $V_G$ of the counterweight 23. For clarification, in FIGS. 1A and 1C a projection K1 of a floor 15.1 of the elevator car 15 and a projection G1 of an underside 23.2 of the counterweight 23 are shown each projected onto the shaft floor. The projections K1 and G2 are illustrated by dashed lines in the regions in which they overlap a base area 12.1 of the base element 12 at the shaft floor 18.

The movable means 14 and 14.1 are, in the illustrated form of embodiment, constructed to be asymmetrical. The left-hand, trapezium-shaped part 14 projects laterally further out of the upper part 13 than the right-hand trapezium-shaped part 14.1. In addition, the movable means 14 and 14.1 are moved to different heights above the shaft floor 18 through the paths $V_K$ and $V_G$: an upper part of the movable means 14 is arranged at a height Z1.1 and an upper part of the movable means 14.1 is arranged at a height Z1.2, wherein Z1.2 is greater than Z1.1 (FIGS. 1D and 1E).

Figure 1C:
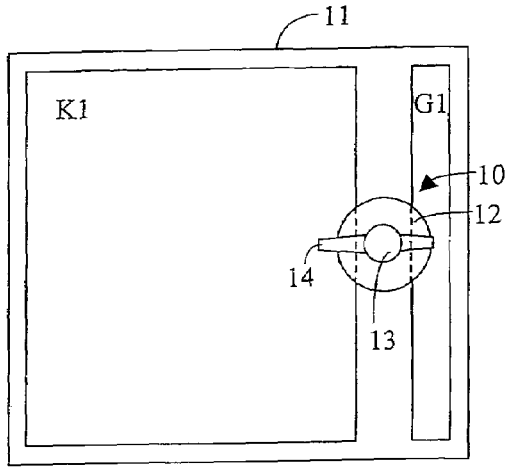
FIG. 1C is a schematic plan view of the first buffer, in a use state.
Figure 1B:
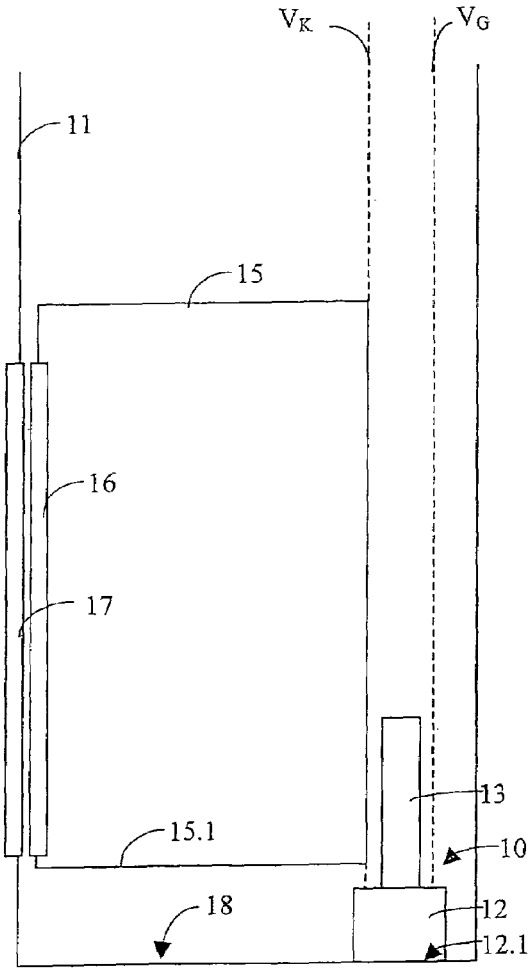
FIG. 1B is a schematic side elevation view of the first buffer, in the normal state.
Figure 1D:
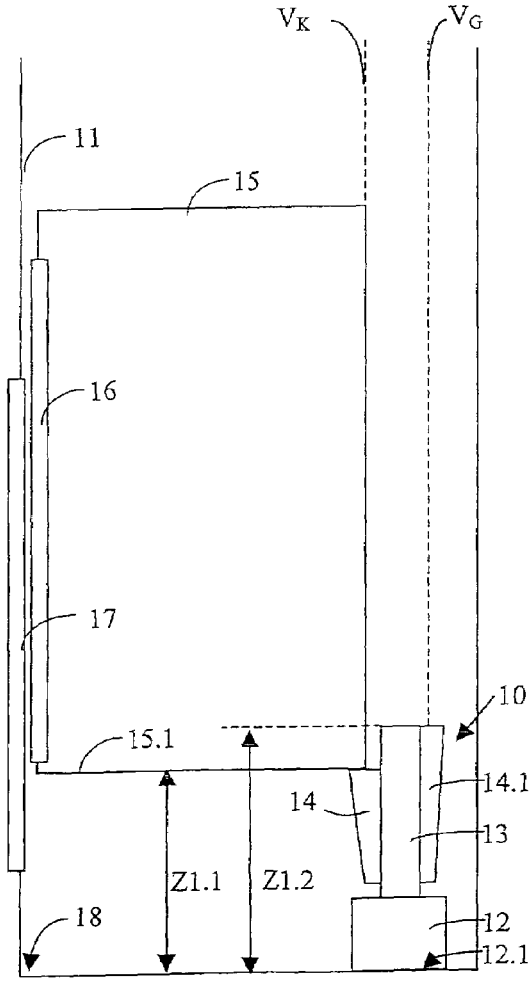
FIG. 1D is a schematic side elevation view of the first buffer, in the use state, wherein a temporary zone of protection is created.
Figure 1E:
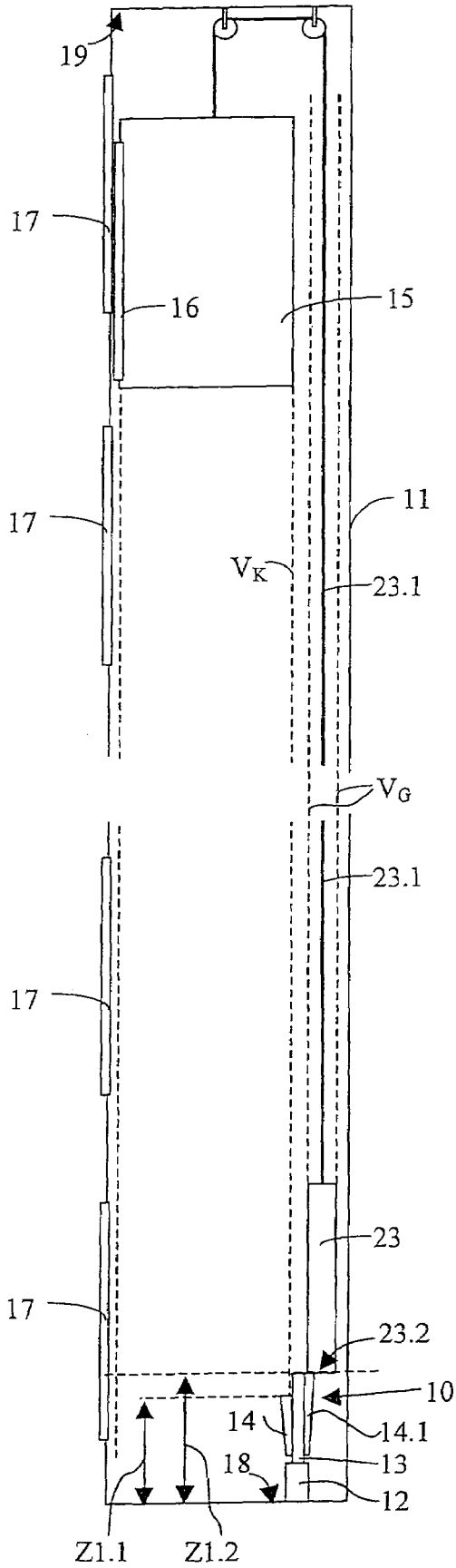
FIG. 1E is a schematic side elevation view of an entire elevator shaft with the first buffer, in the use state, wherein a counterweight is seated on the buffer and a zone of protection is created at the upper shaft end.

The buffer 10 is shown in FIGS. 1A and 1B in a so-termed normal state. In the normal state of the buffer, the movable means 14 and 14.1 are disposed outside the paths $V_K$ and $V_G$. The respective settings which the movable means 14 and 14.1 adopt in the normal state of the buffer are termed normal setting in the following.

Since in the normal state of the buffer 10 the upper part 13 of the buffer 10 does not project into the path $V_K$ of the elevator car 15, the elevator car 15 can move to a shaft door 17 of the lower floor without producing a mechanical contact with the buffer 10. In the situation shown in FIG. 1B, boarding and disembarkation can take place through a car door 16 and the shaft door 17.

The buffer 10 is illustrated in a so-termed use state in FIGS. 1C, 1D and 1E. In a use state of the buffer the movable means 14 is brought into the path $V_K$ and/or the movable means 14.1 is brought into the path $V_G$, i.e. the movable means 14 and/or the movable means 14.1 is or are disposed in the respective use setting thereof. If the movable means 14 is in its use setting, the elevator car 15 can be brought into a mechanical contact with the means. If the movable means 14.1 is in its use setting, the counterweight 23 can be brought into mechanical contact with the means 14.1.

If the movable means 14 is brought into its use setting and the buffer 10 is thus disposed in use state, then a mechanical contact of the elevator car 15 with the movable means 14 of the buffer 10 takes place as soon as the elevator car 15 has fallen below a first predetermined spacing, in the present case the spacing Z1.1, with respect to the floor 18. In the case of the illustrated form of embodiment, the elevator car 15 sits by a lower edge on the movable means 14, as shown in FIG. 1D.

The buffer 10 together with the movable means 14 and 14.1 is so constructed and arranged that a mechanical contact with the counterweight 23 also takes place when the movable means 14.1 is brought into its use setting and the buffer 10 is thus in the use setting and the counterweight 23 falls below the predetermined spacing Z1.2 with respect to the floor 18. The counterweight 23 is not visible in FIGS. 1A to 1D, since it is disposed at the upper shaft end when the elevator car 15 is disposed at the lower shaft end.

Since the elevator shaft 11 is a shaft without a shaft pit, a zone of protection in the region of the lower shaft end must be able to be created in the case of need. For creating the zone of protection, the buffer 10 is transferred from the normal state to the use state, wherein this takes place in that the movable means 14 is moved out of the upper part 13. The elevator car 15 can now move downwardly until it settles on the movable means 14 and is supported by the buffer 10 at the spacing Z1.1 with respect to the floor 18. In this manner a zone of protection is created below the elevator car 15. The shaft door 17 is arranged in such a manner that a person can enter and/or leave the zone of protection by opening of the shaft door 17. The spacing Z1.1 ensures sufficient distance from the floor 18 in order to enable safe and problem-free working in the zone of protection.

A temporary zone of protection in the region of the upper shaft end can also be created by the buffer 10. That is shown in FIG. 1E. A schematic longitudinal section through the entire elevator shaft 11 is shown in this figure. The elevator shaft 11 has four, or more than four, floors. One of the shaft doors 17 is indicated at the level of each of the floors. The counterweight 23 moves in opposite sense to the elevator car 15 in the elevator shaft 11. If the elevator car is disposed at the upper shaft end, then the counterweight 23 is disposed at the lower shaft end. In order to create a zone of protection at the upper shaft end, the counterweight is prevented from moving below the spacing Z1.2 relative to the floor 18. As soon as the counterweight 23 is seated on the movable means 14.1, the elevator car 15 is also held at a fixedly predetermined spacing from the shaft head. A zone of protection at the upper shaft end thereby results.

It is possible to so construct the buffer 10 that the base element 12 also acts as a damping element. In this case, the base element 12 absorbs the kinetic energy of the elevator car 15 or the kinetic energy of the counterweight 23 and brakes the elevator car 15 or the counterweight 23 when the elevator car 15 and/or the counterweight 23 comes or come into mechanical contact with the buffer 10. This applies not only to the case that the elevator car 15 and/or the counterweight 23 is or are seated directly on the base element 12, but also to the case that the elevator car 15 or the counterweight 23 is seated on the movable means 14 or 14.1.

If overrunning of the lowermost stopping position of the elevator car 15 in downward direction takes place, a lower edge of the elevator car 15 seats on the base element 12, as is evident from FIG. 1B. The base element 12 acting as a damping element absorbs the kinetic energy of the elevator car 15 and brakes the elevator car 15 until this comes to a stop. In this form of embodiment the buffer 10 can serve not only for creation of zones of protection, but also as an overrun protection.

Figure 1F:
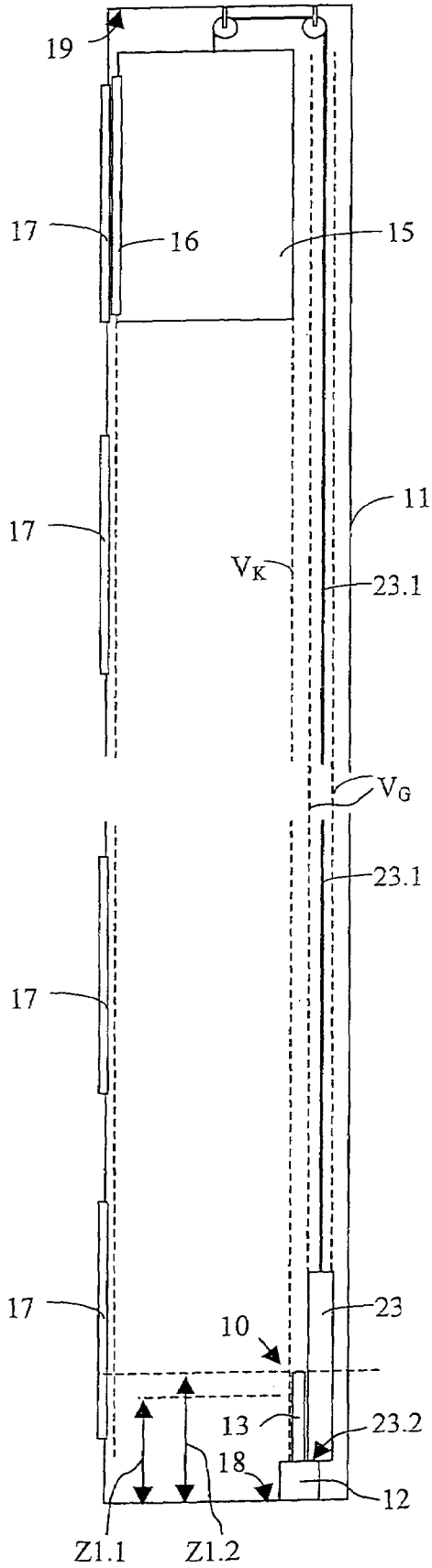
FIG. 1F is a schematic side elevation view of the elevator shaft with the first buffer, in the normal state, wherein a counterweight is seated on the buffer and overrunning of an uppermost stopping position in the upward direction is prevented.

The form of embodiment of FIGS. 1A to 1F is distinguished by the fact that it not only prevents overrunning of the lowermost stopping position of the elevator car 15 in the downward direction, but that also an overrunning of the uppermost stopping position of the elevator car 15 in the upward direction is arrested. This "emergency case" is illustrated in FIG. 1F. A schematic longitudinal section through the entire elevator shaft 11 is shown in this figure. The buffer 10 is set in the normal state. Overrunning of the uppermost stopping position of the elevator car 15 in the upward direction is now stopped in that the counterweight 23 mechanically interacts with the base element 12 of the buffer 10. Due to the braking and stopping of the counterweight 23 by the buffer 10, the elevator car 15 is prevented from travelling further upwards.

In another form of embodiment the drive unit of the elevator installation is seated in or directly under the base element 12. In this case the base element would look different in plan view (FIGS. 1A and 1B). For example, in this case the drive pulley, which is driven by the drive unit, for the support cable would be arranged at the base element 12.

It is an advantage of the present invention that it provides different functions with the smallest number of elements and with little space requirement.

The base element 12 does not necessarily have to project into the paths $V_K$ and $V_G$ if the buffer 10 is to be used exclusively as a device for the creation of protective spaces and does not additionally have to serve as an overrun protection for the elevator car. In this case, the elevator car 15 and the counterweight 23 could not be brought into a mechanical contact with the buffer 10 if the movable means 14 and 14.1 adopt the normal setting. In this case an overrun protection could be realized in that additional buffers, which separately act on the elevator car 15 and/or the counterweight 23 and the dimensions of which are matched to the position of the lowermost and/or the uppermost stopping position of the elevator car 15, are installed in the elevator shaft 11.

FIGS. 2A to 2D show—as a second embodiment of the present invention—an elevator installation with a buffer 30 in different schematic views and in different states. The illustrated buffer 30 is a buffer for supporting an elevator car 35 above a floor 38 of an elevator shaft 31. The buffer serves as an overrun protection and as means for creation of a temporary zone of protection. The elevator car 35 is so connected with a counterweight that the elevator car 35 is movable upwardly and downwardly along a path $V_K$, and the counterweight upwardly and downwardly along a path $V_G$, in the elevator shaft 31. The counterweight, a support means for the elevator car 35 and the counterweight, a drive pulley, guide rails and other usual elements of an elevator installation are not shown in FIGS. 2A to 2D. The buffer 30 has a longitudinal extent substantially parallel to the paths $V_K$ and $V_G$ of the elevator car 35 and the counterweight. The buffer 30 is so constructed and arranged that it projects at least partly into the path $V_K$ of the elevator car and the path $V_G$ of the counterweight.

The buffer 30 comprises a lower base element 32, which is designed as a stronger damper, and a more slender upper part 33, which is designed as a weaker damper. The buffer 30 comprises movable means 34 which are seated on the upper part 33 and can be rotated between different settings, as indicated in FIGS. 2B and 2D. The movable means 34 are symmetrically constructed in the case of the illustrated form of embodiment, i.e. they project out by equal amounts on both sides beyond the upper part 33.

Figure 2A:
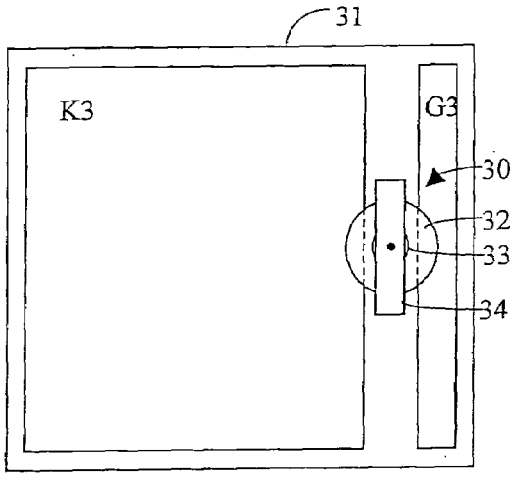
FIG. 2A is a schematic side elevation view of a second buffer according to the present invention, in a normal state.
Figure 2C:
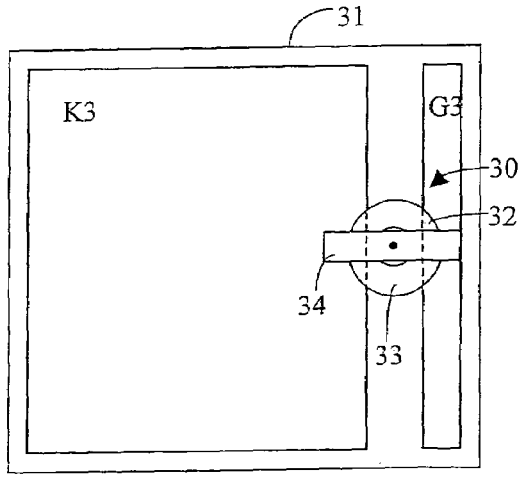
FIG. 2C is a schematic plan view of the second buffer, in a use state.
Figure 2B:
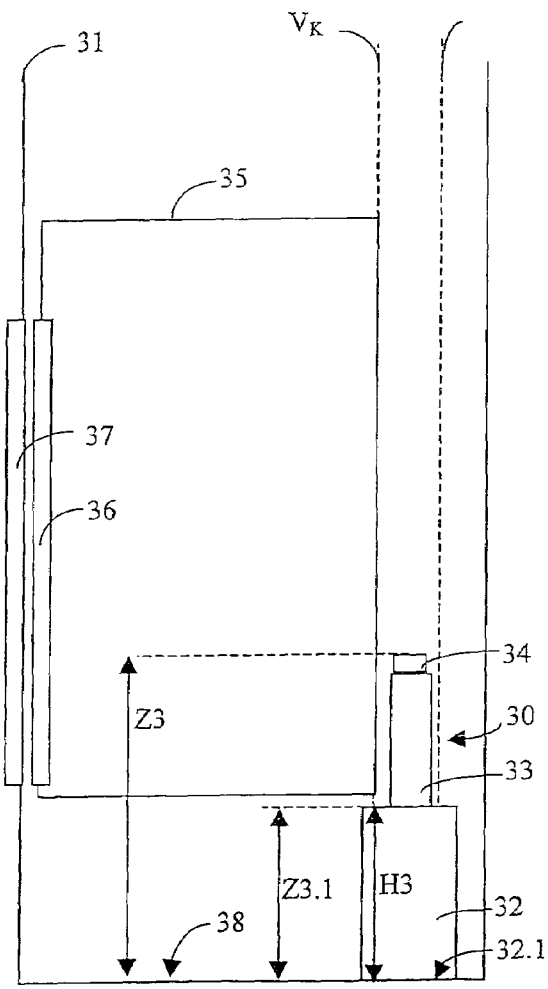
FIG. 2B is a schematic side elevation view of the second buffer, in the normal state.
Figure 2D:
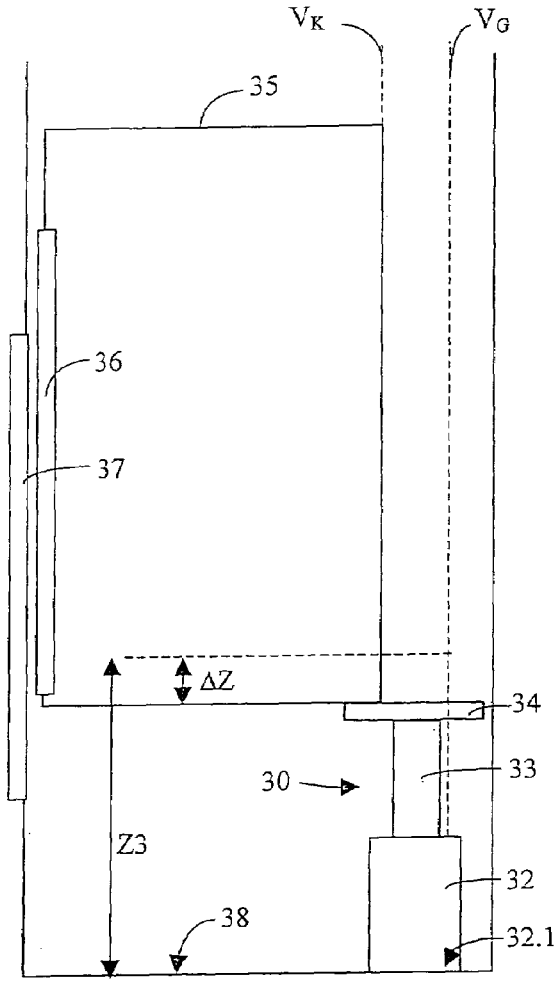
FIG. 2D is a schematic side elevation view of the second buffer, in the use state, wherein a temporary zone of protection is created at the shaft floor.

The buffer 30 is shown in FIGS. 2A and 2B in a so-termed normal state. In this case, the movable means 34 is disposed in its normal setting, i.e. it does not project into the paths $V_K$ and $V_G$. In FIGS. 2C and 2D the buffer 30 is illustrated in a so-termed use state. In this case, the movable means 34 is disposed in its use setting, i.e. it projects into the paths $V_K$ and $V_G$. The buffer 30 is disposed at least partly between the path $V_K$ of the elevator car 35 and the path $V_G$ of the counterweight. For clarification, in FIGS. 2A and 2C a projection K3 of the elevator car 35 and a projection G3 of the counterweight are shown in each instance projected onto the shaft floor. The projections K3 and G3 are illustrated by dashed lines in the regions in which they overlap a base area 32.1 of the base element 32 at the shaft floor 38.

In the use state, a mechanical contact of the elevator car 35 with the movable means 34 of the buffer 30 takes place as soon as the elevator car 35 has fallen below a first predetermined space Z3 with respect to the floor 38. In the case of the illustrated form of embodiment, the elevator car 35 is seated by a lower edge on the movable means 34, as shown in FIG. 2D. A temporary zone of protection in the region of the lower shaft end can thereby be created in the case of need.

The buffer 30 with the movable means 34 is so constructed and arranged that in the use state a mechanical contact with the counterweight also takes place when the counterweight falls below the predetermined spacing Z3 with respect to the floor 38. The counterweight is not visible in FIGS. 2A to 2D, since it is disposed at the upper shaft end when the elevator car 35 is disposed at the lower shaft end.

The buffer 30 is shown in normal state in FIG. 2B. Since the upper part 33 of the buffer 30 does not project into the path of the elevator car, the elevator car 35 can travel to a shaft door 37 of the lower floor without producing a mechanical contact with the buffer 30. In the situation shown in FIG. 2B, boarding or disembarkation can take place via a car door 36 and the shaft door 37 when the elevator car adopts the lowermost stopping position at the lowermost floor.

If overrunning of the lowermost stopping position of the elevator car 35 in the downward direction (not shown in FIGS. 2A to 2D) now occurs, then a mechanical contact of the elevator car with the base element 32, which is designed as a stronger damper, of the buffer 30 takes place as soon as the elevator car 35 has fallen below a predetermined spacing Z3.1 with respect to the floor 38. In the case of the illustrated form of embodiment the elevator car 35 is then seated by a lower edge on the base element 32. The elevator car 35 can thereby be braked and stopped in the "emergency case".

For creation of a zone of protection, the buffer 30 is transferred from the normal state to the use state, wherein this takes place in that the movable means 34 are rotated about an axis of rotation which is aligned substantially parallel to the path $V_K$ of the elevator car 35 or to the path $V_G$ of the counterweight. The respective setting of the movable means is controlled by means of a drive and a control device acting on the drive. The drive and the control device are not illustrated in the figures. The elevator car 35 can be moved downwardly until it settles on the movable means 34. In this manner a zone of protection is created below the elevator car 35. A shaft door 37 is arranged in such a manner that a person can enter and/or leave the zone of protection by opening of the shaft door 37. The spacing Z3 ensures sufficient distance from the floor 38 in order to enable a safe and problem-free working in the zone of protection.

Since in the illustrated form of embodiment there is concerned an elevator installation with a shaft pit and since the base element 32 has a longitudinal extent H3, there is created every time a flat zone of protection into which the elevator car 35 cannot penetrate. Even if due to a fault or due to erroneous operation the necessary changeover into the use state is not carried out, a person in the elevator shaft cannot be crushed, since a minimum spacing is always given by the height H3 of the base element 32.

The base element 32 and/or the lower part 33 has or have a length in the direction of the path $V_K$ or $V_G$ dependent on the mechanical loading thereof. The load-dependence of this extent substantially determines the capability of the base element 32 or of the upper part 33 of braking and stopping the elevator car or the counterweight when impinging on the buffer 30. In order to indicate the loading of the buffer 30 by the elevator car 35, in FIG. 2D the length of the buffer 30 in the direction of the path $V_K$ is illustrated reduced by a distance ΔZ by comparison with the spacing Z3. In analogous manner the extent of the buffer 30 in the direction of the path $V_G$ is reduced by a height below the spacing Z3 when the counterweight loads the buffer 30.

A temporary zone of protection in the region of the upper shaft end can also be created by the buffer 30. This state is not, however, shown in FIGS. 2A to 2D. In order to create a zone of protection at the upper shaft end, the movable means 34 are moved into the path $V_G$ of the counterweight and the counterweight is supported by the buffer 30 as soon as the counterweight moves below the spacing Z3 from the floor 38. As soon as the counterweight is seated on the right-hand side of the movable means 34, the elevator car 35 is also held at a fixedly predetermined spacing from the shaft head. A zone of protection at the upper shaft end thereby results.

FIGS. 3A to 3D show—as a third embodiment of the present invention—an elevator installation with a buffer 40 in different schematic views and in different states. The illustrated buffer 40 is a buffer for supporting an elevator car 45 above a floor 48 of an elevator shaft 41. The buffer serves as overrun protection and as means for creating a temporary zone of protection in an elevator installation without a pit, i.e. in an elevator installation in which the lowermost stopping level of the elevator car lies at such a short distance above the floor that no space for a shaft pit is present. The elevator car 45 is so connected with a counterweight that the elevator car 45 and the counterweight are movable upwardly and downwardly along paths in the elevator shaft 41. The counterweight, a support means for the elevator car 45 and the counterweight, a drive pulley, guide rails and other usual elements of an elevator installation are not shown in FIGS. 3A to 3D. The buffer 40 has a longitudinal extent substantially parallel to the paths of the elevator car 45 and the counterweight. The buffer 40 is so constructed and arranged that it projects at least partly into the path of the elevator car and into the path of the counterweight, depending on the respective state.

Figure 3A:
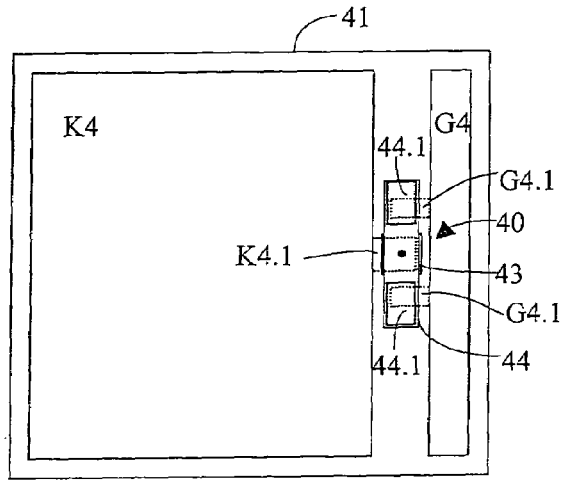
FIG. 3A is a schematic plan view of a third embodiment of a buffer according to the present invention, in a normal state.
Figure 3C:
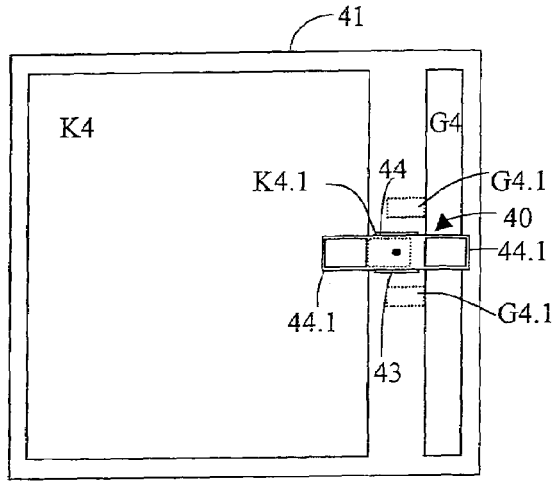
FIG. 3C is a schematic plan elevation view of the third buffer, in a use state.
Figure 3B:
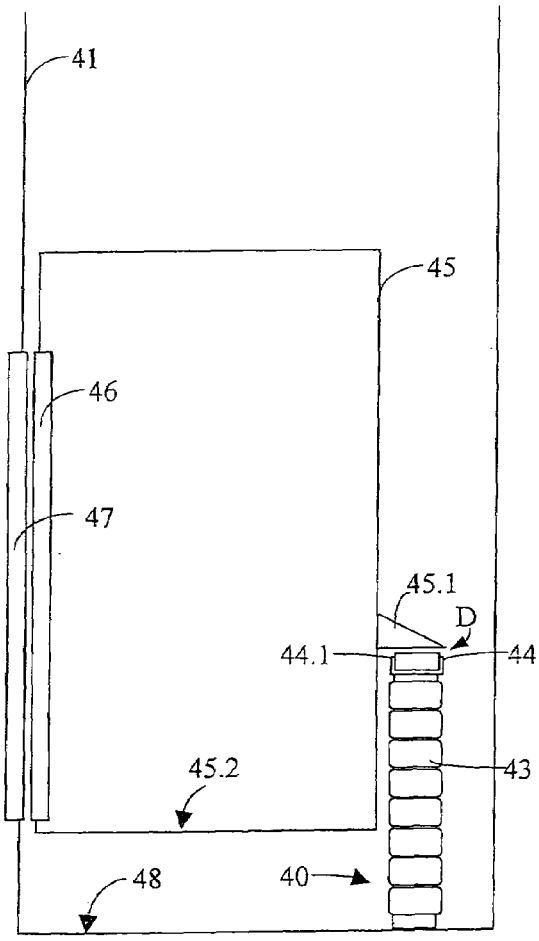
FIG. 3B is a schematic side elevation view of the third buffer, in the normal state, wherein the elevator car travelling downwardly beyond the lowermost stopping position is halted.
Figure 3D:
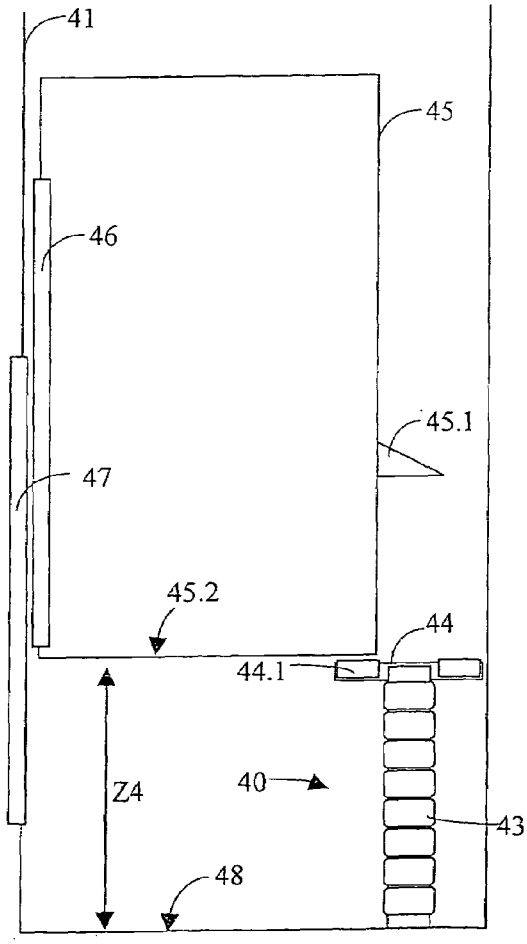
FIG. 3D is a schematic side elevation view of the third buffer, in the use state, wherein a temporary zone of protection is created.

The buffer 40 comprises a lower base element 43, which is constructed as a stronger damper, and movable means 44, which are seated on the base element 43 and can be rotated, as indicated in FIGS. 3C and 3D. The movable means 44 are symmetrically constructed in the case of the illustrated form of embodiment, i.e. they project out by equal amounts on both sides beyond the base element 43. The movable means 44 comprise dampers 44.1, which are seated in recesses of the movable means 44.

The buffer 40 is shown in FIGS. 3A and 3B in a so-termed normal state. In this case the movable means 44 and 44.1 are disposed in their normal setting, i.e. they do not project into the paths of the elevator car 45 and the counterweight. The buffer 40 is illustrated in a so-termed use state in FIGS. 3C and 3D. In this case the movable means 44 and 44.1 are disposed in their use setting, i.e. they project into the paths of the elevator car 45 and the counterweight. The buffer 40 is disposed at least partly between the path of the elevator car and the path of the counterweight. For clarification, a projection K4 of a floor 45.2 of the elevator car 45 and a projection G4 of the underside of the counterweight are shown in FIGS. 3A and 3C.

In the use state, a mechanical contact with the elevator car 45 with the damper 44.1 of the buffer 40 takes place as soon as the elevator car 45 moves below a first predetermined spacing Z4 with respect to the floor 48. In the case of the illustrated embodiment the elevator car 45 is seated by a lower edge on the damper 44.1, as shown in FIG. 3D. The buffer 40 is thus eccentrically loaded. A temporary zone of protection can thereby be created in the region of the lower shaft end in the case of need.

The buffer 40 with the movable means 44, 44.1 is so constructed and arranged that in the use state a mechanical contact with the counterweight also takes place when the counterweight moves below the predetermined spacing Z4 with respect to the floor 48. The counterweight is not visible in FIGS. 3A to 3D, since it is disposed at the upper shaft end when the elevator car 45 is disposed at the lower shaft end.

The buffer 40 is shown in normal state in FIG. 3B. Since in the normal state the movable means 44, 44.1 of the buffer 40 do not project into the path of the floor 45.2 of the elevator car 45, the elevator car 45 can travel to a shaft door 47 of the lower floor without producing a mechanical contact with the buffer 40. It is mentioned that in the illustrated state a spacing D between a bracket 45.1 (buffer abutment), which is fastened to the elevator car 45, and the movable means 44.1 exists. In the situation shown in FIG. 3B, boarding or disembarkation can take place via a car door 46 and the shaft door 47.

If overrunning of the lowermost stopping position of the elevator car 45 in downward direction (not shown in FIGS. 3A to 3D) now occurs, then a mechanical contact of the bracket 45.1, which is fastened to the elevator car 45, with the means 44 or with the base element 43, which is constructed as a stronger damper, of the buffer 40 takes place. The elevator car 45 can thereby be braked and stopped in the "emergency case". It may be noted that in the case of overrunning the lowermost stopping position of the elevator car 45 the damper 44.1 does not come into use, since the bracket 45.1 produces direct contact with the means 44. The buffer 40 is thus centrally loaded in such an "emergency case".

If the movable means 44 and 44.1 adopt the normal setting, then an overrunning of the uppermost stopping position of the elevator 45 in upward direction is prevented in that a bracket or another protruding element at the side of the counterweight facing the shaft door 47 produces a contact with the movable means 44 of the buffer 40. This, too, leads to a central loading of the buffer 40.

For clarification, a projection K4.1 of the bracket 45.1 and a projection G4.1 of the bracket or of the protruding element at the counterweight, each projected onto the shaft floor, are illustrated in FIGS. 3A and 3C in each instance by dashed lines.

For creation of a zone of protection, the buffer 40 is transferred from the normal state to the use state, wherein this takes place in that the movable means 44 are rotated into the paths of the floor 45.2 of the elevator car 45 and the underside of the counterweight (FIGS. 3C and 3D). The necessary changeover can be triggered by, for example, a (key-operated) switch or in electronically controlled manner.

In order to create the temporary zone of protection, the elevator car 45 is moved slowly downwardly until it settles on the damper 44.1. A person can enter and/or leave the zone of protection by opening of the shaft door 47. The spacing Z4 guarantees sufficient distance from the floor 48 in order to enable a safe and problem-free working in the zone of protection.

A temporary zone of protection in the region of the upper shaft end can also be created by the same buffer 40. However, this state is not shown in FIGS. 3A to 3D. In order to create a zone of protection at the upper shaft end, the counterweight is prevented from falling below the spacing Z4 from the floor 48. As soon as the counterweight is seated on the damper 44.1 on the right-hand side of the movable means 44, the elevator car 45 is also held at a fixedly predetermined spacing from the shaft head. A zone of protection at the upper shaft end thereby results.

As indicated in FIGS. 1D and 1E, the elevator car and the counterweight do not have to be supported at the same height. The form of embodiment according to FIGS. 2A to 2D and 3A to 3D can be appropriately modified by a suitable adaptation of the shapes of the movable means 34 and 44 or 44.1.

According to the present invention the buffer can have a damping characteristic which is specially matched to the case of use. In the case of the third embodiment, the dampers 44.1 are used which enable a lightly damped seating of the elevator car 45 or of the counterweight on the movable means 44 when a zone of protection is to be created. The movable means 44 are thus treated gently in operation. If the elevator car and/or the counterweight impinges or impinge at high speed on the respective buffer—particularly during overrunning beyond the lowermost or the uppermost stopping position of the elevator car—then, thereagainst, the damping characteristics of the base elements 12, 32 and 43 come into use.

The buffer according to present the invention can be equipped with special means which allow an asymmetrical loading without the buffer "collapsing" or "deflecting". For this purpose the buffer can be surrounded entirely or partly by a corset-like element or be guided by a special means in order to provide compensation for the bending moments arising due to the eccentric buffer loading.

In the case of a part of the embodiments shown the buffer is arranged completely between the elevator car and the counterweight (see, for example, FIG. 3A).

In the case of a further embodiment the buffer element can be arranged entirely or partly below the counterweight and act directly on the counterweight. A movable means of the buffer element then correspondingly acts on the elevator car in the case of need.

The cross-section of the buffer can be selected as desired. The buffers 10 and 30 have a substantially round cross-section parallel to the floor of the elevator shaft. The buffer 40, thereagainst, has, for example, a square cross-section in the lower region 43.

Movement of the movable means of the buffer can take place electromagnetically, hydraulically, pneumatically, manually or by means of a setting motor, depending on the respective form of embodiment.

In a further embodiment there is used a pit set which comprises a drive/frequency-converter unit, a speed limiter, a fastening for the guide rails and the buffer. Assembly in the elevator shaft is thereby appreciably simplified.

The present invention is also suitable for use in an elevator installation in cantilever disposition.

Through the special arrangement and construction of the buffer there results a reduced space requirement by comparison with conventional solutions.

The present invention is particularly suitable for use in elevator shafts which have no or only small shaft pit and shaft head height dimensions.

It is an advantage of the present invention that regulations for fulfillment of personal protection are maintained and the constructional costs and installation costs, depending on the respective form of embodiment, can be substantially reduced.

The movable means 14, 14.1, 34, 44 and 44.1 can be modified in different ways within the scope of the invention. They can be replaced by means which are foldable, pivotable, slidable and/or rotatable out of a basic setting and movable in each instance into the path or paths of the elevator car and/or the counterweight in order to support the elevator car and/or the counterweight at a spacing above the floor. The movable means can also be so constructed by a suitable arrangement that the elevator car and the counterweight can in each instance be supported at different heights. The can be of multi-part or also of integral construction.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A buffer for an elevator installation for creating at least one zone of protection, wherein the elevator installation includes an elevator car and a counterweight movable along respective paths in an elevator shaft, the buffer comprising:

a base element adapted to be mounted in the elevator shaft; and a movable means attached to said base element wherein when said base element is mounted in the elevator shaft, said movable means is movable to a use setting in the path of the elevator car for creating a first zone of protection in a lower end of the elevator shaft and the path of the counterweight for creating a second zone of protection in an upper end of the elevator shaft.

2. The buffer according to claim 1 wherein said movable means is movable to said use setting for mechanical contact with the elevator car when the elevator car moves below a first predetermined spacing with respect to a floor of the elevator shaft.

3. The buffer according to claim 2 wherein said movable means is movable to said use setting for mechanical contact with the counterweight when the counterweight moves below a second predetermined spacing with respect to the floor of the elevator shaft.

4. The buffer according to claim 1 wherein said movable means is movable to said use setting for mechanical contact with one of the elevator car and the counterweight when the one of the elevator car and the counterweight moves below a predetermined spacing with respect to a floor of the elevator shaft.

5. The buffer according to claim 4 wherein when said movable means is in said use setting, said movable means is movable out of the path of the elevator car and the path of the counterweight.

6. The buffer according to claim 1 wherein said movable means is movable to a normal setting in which no mechanical contact takes place between said movable means and the elevator car when the elevator car moves below a first predetermined spacing with respect to a floor of the elevator shaft and in which no mechanical contact takes place between said movable means and the counterweight when the counterweight moves below a second predetermined spacing with respect to the floor of the elevator shaft.

7. The buffer according to claim 1 wherein when said movable means is in said use setting mechanical contact is made with the elevator car to support the elevator car above a floor of the elevator shaft thereby forming a zone of protection between the floor and the elevator car.

8. The buffer according to claim 1 wherein when said movable means is in said use setting mechanical contact is made with the counterweight to support the counterweight above the floor of the elevator shaft.

9. The buffer according to claim 8 wherein the elevator car and the counterweight are connected by a carrier means of such a length that when the counterweight is supported above the floor by said movable means at a predetermined height, a zone of protection is formed above the elevator car between an upper region of the elevator car and the upper end of the elevator shaft.

10. The buffer according to claim 1 wherein said buffer has a damping characteristic proving a soft settling when mechanical contact is made with one of the elevator car and the counterweight.

11. The buffer according to claim 1 wherein said buffer has an upper part disposed between an area projection of the elevator car and an area projection of the counterweight.

12. The buffer according to claim 1 wherein said movable means are movable to said use setting by one of folding out, pivoting, sliding or rotating.

13. The buffer according to claim 1 wherein when said base element projects into the path of the elevator car for mechanical contact with the elevator car to support the elevator car at one predetermined spacing above a floor of the elevator shaft which is less than another predetermined spacing above the floor when said movable means is in said use setting.

14. The buffer according to claim 1 wherein when said base element projects into the path of the counterweight for mechanical contact with the counterweight to support the counterweight at one predetermined spacing above a floor of the elevator shaft which is less than another predetermined spacing above the floor when said movable means is in said use setting.

15. The buffer according to claim 1 wherein said base element provides an overrun protection which through mechanical contact of said movable means with the elevator car, said base element brakes and stops the elevator car when overrunning a lowermost stopping position in a downward direction of travel.

16. The buffer according to claim 1 wherein said base element provides an overrun protection which through mechanical contact of said movable means with the counterweight, said base element brakes and stops the counterweight in a downward direction of travel end thus brakes and stops the elevator car when overrunning an uppermost stopping position in an upward direction of travel.

17. The buffer according to claim 1 wherein the elevator shaft does not have a pit.

18. A method of creating a zone of protection in an elevator installation with a buffer mounted in an elevator shaft and an elevator car connected with a counterweight for movement along respective paths in the elevator shaft, the method comprising the steps of:

a) providing the buffer with a movable means;

b) moving the movable means into the path of the elevator car when there is a need for a zone of protection below the elevator car, wherein the zone of protection is created by a mechanical contact of the movable means with the elevator car and ensures a maintenance person of a first predetermined spacing between the elevator car and a floor of the elevator shaft; and c) moving the movable means into the path of the counterweight when there is a need for a zone of protection above the elevator car, wherein the zone of protection is created by a mechanical contact of the movable means with the counterweight and ensures a maintenance person of a second predetermined spacing between the elevator car and an upper end of the elevator shaft.

19. The method according to claim 18 including a step of moving the movable means out of the paths of the elevator car and the counterweight if there is no need for a zone of protection.

* * * * *